US006009698A

United States Patent [19]

Dinkelmann et al.

[11] Patent Number: 6,009,698

[45] Date of Patent: Jan. 4, 2000

[54] METHOD OF OPERATING A RING-SPINNING MACHINE WITH VERTICALLY SHIFTABLE THREAD-GUIDE EYES

[75] Inventors: Friedrich Dinkelmann, Rechberghausen; Andreas Olbrich, Kirchheim/Teck; Angelika Stoll, Köngen, all of Germany

[73] Assignee: Zinser TextilMaschinen GmbH, Ebersbach/Fils, Germany

[21] Appl. No.: 09/041,093

[22] Filed: Mar. 12, 1998

[30] Foreign Application Priority Data

Mar. 13, 1997 [DE] Germany ..... 197 10 335

[51] Int. Cl.[7] ..... D01H 7/52

[52] U.S. Cl. ..... 57/75; 57/264; 57/352

[58] Field of Search ..... 57/264, 75, 122, 57/352

[56] References Cited

U.S. PATENT DOCUMENTS

| | | | |
|---|---|---|---|
| 2,949,726 | 8/1960 | Latus | 57/75 |
| 3,015,931 | 1/1962 | Kooistra et al. | 57/75 |
| 3,521,441 | 7/1970 | Lamparter | 57/90 |
| 5,551,223 | 9/1996 | Nickolay | 57/264 |
| 5,694,757 | 12/1997 | Smekal et al. | 57/75 |

FOREIGN PATENT DOCUMENTS

| | | | |
|---|---|---|---|
| 389849 | 3/1990 | European Pat. Off. | 57/264 |
| 1 002 510 | 10/1946 | France . | |
| 1 002 510 | 3/1952 | France . | |
| 1 600 156 | 8/1970 | France . | |
| 2 286 897 | 10/1975 | France . | |
| 2 112 035 | 9/1972 | Germany . | |
| 25 43 581 | 4/1976 | Germany . | |
| 44 02 582 A1 | 8/1995 | Germany . | |
| 1 213 035 | 2/1986 | Italy . | |
| 09003733 | 1/1997 | Japan . | |

*Primary Examiner*—William Stryjewski
*Attorney, Agent, or Firm*—Herbert Dubno

[57] ABSTRACT

Thread breakage rates of a ring-spinning machine are measured successively and/or from different zones at the spindle stations and a thread guide between a headpiece of each spindle and the output rollers of the drafting frames can be vertically adjusted in response to a difference in the thread break rates.

12 Claims, 2 Drawing Sheets

METHOD OF OPERATING A RING-SPINNING MACHINE WITH VERTICALLY SHIFTABLE THREAD-GUIDE EYES

FIELD OF THE INVENTION

Our present invention relates to a method of operating a ring-spinning machine which, as is conventional in such machines, can comprise a row of spindles which may have respective headpieces including thread or yarn-engaging formations spaced downstream from the last rollers of a drafting frame and wherein the thread, yarn or roving fed to a bobbin sleeve on each spindle, passes through a thread guide which can include an eye.

The invention also relates to a method of operating such a machine so as to improve upon the rate of spinning of the yarn and/or an increase in the output of the machine by reducing the yarn breakage rate and, in general, to a method which generally improves the parameters of operation of a ring-spinning machine.

BACKGROUND OF THE INVENTION

A ring-spinning machine customarily comprises a drafting frame in which, at each of a multiplicity of stations, usually along each side of the machine, the drafting frame having a pair of output rollers from which the yarn is delivered to a respective spindle at each station, usually through a thread guide or yarn guide which can be an eye upstream of the spindle.

The spindles, which can receive core sleeves on which the yarn is wound, cooperate with a traveler rings which sweeps around a guide or track ring on the ring rail so as to deposit the yarn in a bobbin. The balloon of yarn formed around the bobbin can be somewhat confined by a constriction ring which like the ring rail and/or the spindle rail can be vertically displaceable.

In such systems, the twist which is imparted to the yarn is predominantly produced in the region between the last pair of rollers of the drafting frame, and the point at which the yarn encounters the spindle. It is a common practice to provide the spindle with a headpiece so that this headpiece can engage the yarn at the lower end of the zone in which the twisting predominantly occurs.

The spindle headpiece, in the sense of the invention, can be a so-called spinning crown as has been described for example in French patent FR 1 002 510 or a so-called spinning finger as described in German patent DE 21 12 035 A1. The invention can be practiced with either of these types of head-pieces.

The purpose of the headpiece on the spindle, which can be the first part of the spindle engaging the yarn or thread, s to confine the yarn balloon during the spinning since the yarn, is wound around or engaged with the headpiece at one end and is paid onto the bobbin at some distance from this end so that significant spreading of the balloon is not possible. The ballooning outwardly is thereby greatly suppressed or reduced.

This reduction in ballooning is, therefore, in part a consequence of the looping of the yarn on the headpiece.

As a result of this balloon suppression effect, the yarn tension in the so-called spinning triangle at the output side of the output pair of rollers of the drafting frame does not depend exclusively on the twist and can contribute to a tendency toward thread breakage. In fact, as a practical matter it is noted that the thread breakage rate tends to increase with the spindle speed and to reduce at the lower spindle speeds.

Because of the looping of the yarn on the spindle headpiece and the looping of the yarn about the traveler on the ring, the yarn path can be treated as being subdivided into three zones each of which operates at a greater yarn tension than the preceding zone.

The first zone can be considered the so-called spinning zone between the output roller pair of the drafting frame and the spindle headpiece.

The second zone can be a so-called "balloon zone," between the spindle headpiece and the traveler.

The third zone can be considered a winding zone between the traveler and the bobbin which is formed on the core sleeve.

Since the yarn tension in the balloon zone is greater than that in the spinning zone and the yarn tension in the winding zone is greater than that in the balloon zone, but the invention concerns itself only with the development of the tension in the spinning zone, the balloon zone and the winding zone can be treated together as a single balloon/winding zone.

From French patent document FR 1,002,510, it is known to vary the distance between the thread guide and the spindle headpiece. It is there described that the position of the thread guide automatically can vary depending upon the build up of the bobbin on the spindle. A control of the position of the thread guide has not been described in any detail, nor is it apparent what effect the displacement of the thread guide can have.

In another system, the adjustment of the distance between the thread guide and the spindle headpiece (see Italian patent document IT 1 213 035) is effected to maintain the thread tension constant.

German patent document DE 25 43 581 A1, page 6, paragraph 2, teaches that varying the distance between the thread guide and the spindle headpiece can vary the number of turns with which the yarn is looped on the spindle headpiece.

OBJECT OF THE INVENTION

It is, therefore, the principal object of the present invention to provide a method of operating a ring-spinning machine which will improve the operating parameters in the case in which a thread guide is provided between the output rollers of the drafting frame and headpiece of the spindle upon which the yarn is looped.

Another object of the invention is to provide an improved method of operating a ring-spinning machine, whereby drawbacks of earlier systems can be obviated.

SUMMARY OF THE INVENTION

The invention recognizes that it is possible to control thread breakage by a displacement of the thread guide eye between the output rolls of the drafting frame and the loop or loops of the yarn on the headpiece of the spindle based not upon drawing of the yarn in the winding zone through the traveler ring or the air resistance to the yarn balloon as it rotates about the spindle, but rather upon the ratio of the yarn tension and the looping forces which develop in the aforementioned spinning zone. According to the invention, this can be achieved by detecting at least two yarn break rates, comparing them and varying the distance between the thread guide and the spindle headpiece in dependence upon the sign of the difference between two successive yarn break rates which are compared with one another and in a direction determined by the sign to improve the spinning process.

More particularly, a method of operating a ring-spinning machine can comprise the steps of:

(a) detecting a first thread-breakage rate of the multiplicity of stations with the thread guide at a first spacing from the headpiece over a first time interval;

(b) detecting a second thread-breakage rate of the multiplicity of stations over a second time interval; and (c) comparing the second thread-breakage rate with the first thread-breakage rate and adjusting the spacing in a direction determined by a sign of a difference between the thread-breakage rates and so as to improve a spinning process of the ring spinning machine.

In a first mode of the invention, an initial and subsequent yarn-break rate can be detected and the distance between the thread guide and the spindle headpiece varied in accordance with this difference and in a direction determined by the sign of the difference so as to reduce the thread break rate.

The goal in this case is the minimization of the thread break rate. The process is repeated, i.e. steps (a)–(c) are repeated, until a minimum is reached and, of course, this minimum is thereby maintained with further measurements of thread break rates and comparison of two successive thread break rates.

In another mode of operation of the invention, the process is carried out in the sense of equalizing the successive thread break rates. In other words, once a minimum is reached, the thread break rate can be held constant.

The invention also is applicable to a measurement of the thread break rate for the spinning zone and the thread break rate for the balloon/winding zone and varying the distance of the thread guide from the headpiece of the spindle as a function of this difference and in a direction determined by the sign in the sense of equalizing these two thread break rates. While the thread break rates for the various stations can be inputted to a counter from switches along the machine, each switch can, in accordance with this aspect of the invention, be actuatable to signal a thread break in one or the other of the zones at the station or separating switches can be provided at each station to signal the different thread breaks.

By making the thread break rates in the spinning zone and in the balloon/winding zone equal, the total thread break rate can be minimized in the sense earlier stated.

Of course, the first thread break rate which is detected contains no information as to which direction the thread guide must be adjusted relative to the spindle headpiece to reduce the thread break rate. In this case, it is advantageous to distinguish between the locations at which the thread breaks occur, i.e. whether they occur in the spinning zone or in the balloon/winding zone, and to count up the thread breaks of the two zones separately.

When the thread breaks in the spinning zone are excessive by comparison to the thread breaks in the balloon/winding zone, the tension in the spinning zone may be considered excessive relative to the tension in the balloon/winding zone and the thread guide shifted to reduce this tension. A blind test can be carried out in first and then in the other direction of displacement of the thread guide if desired to minimize the thread breaks, although that can be avoided when one can distinguish between the locations of the thread breaks at the various stations.

The location of the thread break can be determined, for example, by the fact that thread residue from a break in the balloon/winding zone can be found on the spindle headpiece.

Detection of thread break rates can be effected by counting over corresponding periods of time, manually input signals from service personnel. Fully automatic or automatic thread detectors may also be used. In the case in which the service personnel must distinguish between the thread break rates in different zones, separate switches can be provided or a single switch depressed to different extents can be used.

In the operation of the ring-spinning machines, there is usually a permissible thread break rate. In that case, the spindle speed is usually set so that this minimum for permissible thread-break rate is not exceeded.

When a minimum is reached and can be held which is below the permissible rate, the spindle speed can be increased to increase the production until the minimum approaches the permissible thread break rate. Should the minimum thread break rate exceed the permissible value, of course, the spindle speed should be reduced to permit the minimum to fall below the maximum permissible thread break rate.

The thread guides of all spindles, at least along one side of the ring-spinning machine, can be arranged on a common carrier which can be vertically displaceable. The vertical displacement can be carried out by effectors coupled with the carrier and responsive to a control unit which can detect and register the thread breaks over a given period or interval and compare the detected thread break rate with a previously determined thread break rate or a set point representing the maximum permissible thread break rate.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
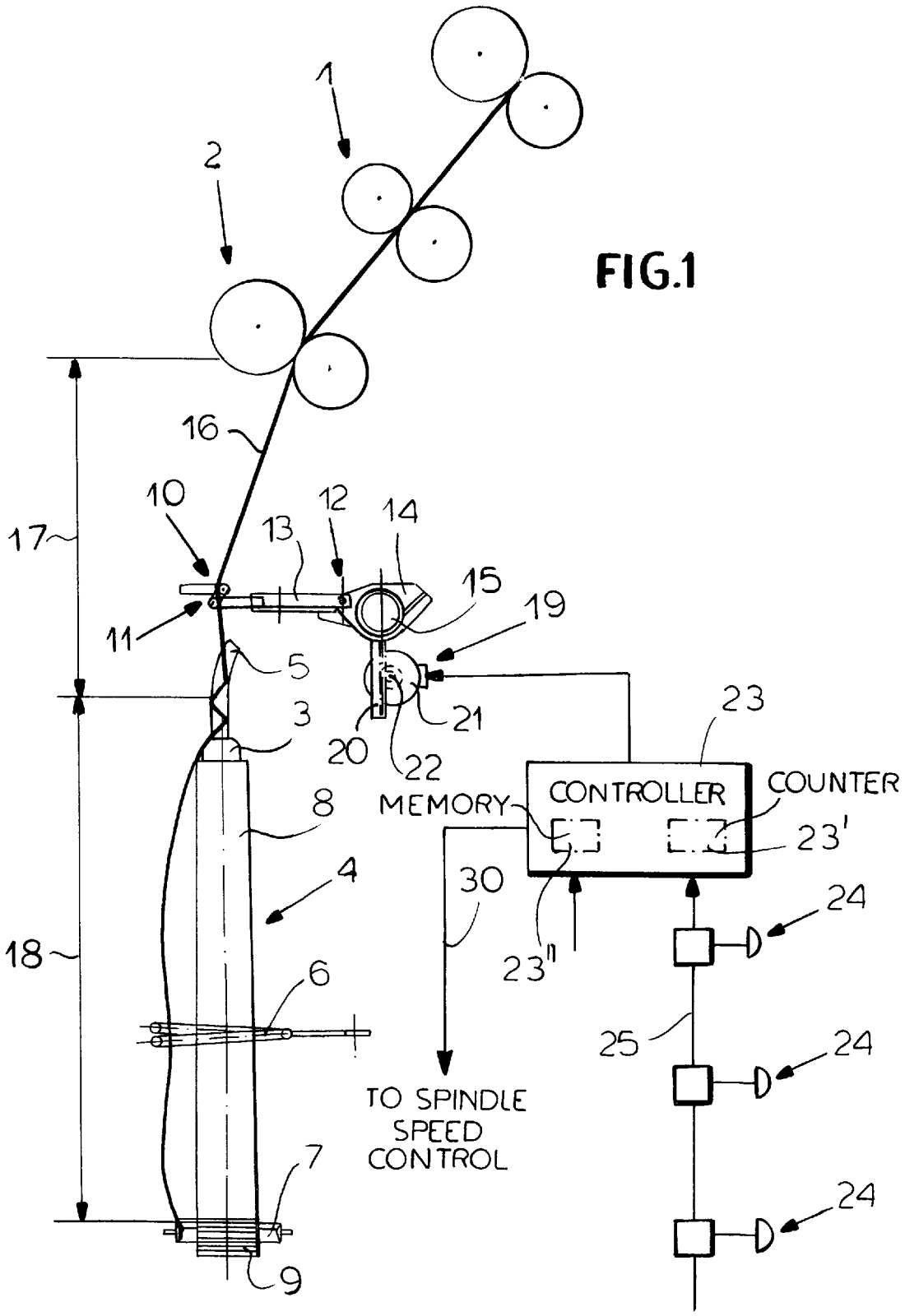
FIG. 1 is a transverse section through a ring-spinning machine in the region of one of the spindles, showing the spindle in elevation and parts of the system in block diagram form.

In the drawing, we have only shown those parts of a ring-spinning machine of otherwise conventional construction which are important to the present invention. As is generally the case, the ring-spinning machine comprises on both longitudinal sides thereof a multiplicity of work stations, each of which has a respective spindle, a traveller ring and a traveller through which the yarn is guided onto the bobbin sleeve on the spindle. Along both sides of the machine, in addition, respective drafting frames 1 are provided and the roving or yarn passes through the respective upper and lower rollers of the drafting frame to form a balloon at the respective spindle. In FIG. 1, the output pair of rollers of the drafting frame is first represented at 1. Generally the upper rollers of the drafting frame are on an arm which can be raised and lowered while the lower rollers of the drafting frame are fixedly positioned and can extend over a major part of the length of the respective sides of the ring-spinning machine.

Each spindle 4 can have a head piece or cap 3 which can be provided with a spinning finger 5 or some other head piece configuration that has been described.

A balloon limiting ring 6 can prevent the balloon from spreading excessively away from the balloon sleeve 8 on which the turns 9 of the bobbin can be deposited should the traveller ride in a spinning ring 7 which can be mounted on a ring rail.

The spindle itself may be mounted on a spindle rail which can move relative to the ring rail or vice versa in the vertical direction to distribute the turns of the bobbin on the core or sleeve 8 which is fitted over the spindle.

As is conventional as well, each of the stations of the ring-spinning machine can be provided with a thread guide 10 which is formed with a thread-guiding eye 11 through which the roving 16 passes. A hinge 12 swingably supports the thread guide flap 11 on which the thread guide 10 is mounted.

The hinge 12 itself is affixed to a support member 14, e.g. the bracket clamping the hinge to a support shaft or tube 15 extending longitudinally along the row of stations on the respective side of the ring-spinning machine. It will be understood that other types of thread guides of conventional construction may also be used and that the invention is therefore not limited to the particular configuration of the thread guide shown.

The region between the output roller pair 2 of the drafting frame 1 and the spinning finger 5 of the head piece 3 of the spindle 4 is referred to as the spinning zone 17 while the region 18 between the spinning finger 5 and the point at which the yarn forms the winding 9 of the bobbin on the sleeve 8 is referred to as the balloon/winding zone.

The support 15 comprises, over its relatively large length, which can extend continuously, if desired, over a great many stations and even the entire length of the working portion along one side of the roving frame, with a number of units 19 for raising and lowering this support. The one unit 19 shown can thus represent a multiplicity of such units equi-spaced along the length of the shaft 15.

Each of the units 19 for raising and lowering the support 15 can comprise a rack 20 and a pinion 22 meshing with the rack 20 and connected to a servomotor 21. Other types of devices for raising and lowering the support 15 can also be used and we can consider, in this regard, threaded spindles and nut arrangements, linear stepping motors, or the like.

The servomotor 21 is operated by a servocontroller 23 which can include a computer or microprocessor which can receive an input representing thread breaks and calculating a thread break rate, for storing the thread break rate and for comparing a previous thread break rate over a selected operating period with a thread break rate for a subsequent operating period and, depending upon this comparison, providing a controller signal for resetting the servomotor 21 as a function of the sign of the difference between the two successive thread break rates. The direction of adjustment of the height (up or down) is effected in a sense tending to reduce the thread break rate.

The actual value of the thread break rate, i.e. a count of the actual number of thread breaks per unit of time, may be provided as an input to the controller 23 by service personnel who are engaged in repairing the thread breaks at the respective stations along the ring-spinning machine, by, for example, punching buttons 24 arrayed along the machine within reach of such service personnel. Each tap of a button will input, for example, a count via line 25 to a counter of the controller 23. The counter is represented at 23' in FIG. 1.

If desired, however, the ring-spinning machine can be provided with an automatic yarn break detection system for counting up the number of yarn breaks along the multiplicity of work stations on each side of the machine. The automatic yarn break sensor may be connected with the system for automatically monitoring a continuity of each of the yarns delivered at the respective stations. In the case of automatic thread feeders or the like, which may be used to repair thread breaks or dropped threads at the various stations, these automatic units can generate the thread break count which is supplied to the controller 23.

Before the ring-spinning machine is set in operation, the thread guide 10 is set to approximately the optimum spacing from the finger 5, for example, about 6 mm. Once the machine has begun operation, the controller unit 23 can count up and total the thread breaks over a certain time period, for example 1000 spindle hours (one spindle hour= (N×M)/60) where N is the number of spindles, M is the minutes for which the spindles are in operation, so that should the thread break rate exceed 58 thread breaks per 1000 spindle hours, the control unit 23 will lift the thread guide 10 by an increment, e.g. of 1 mm, and the thread break rate then counted anew. Should the next thread break rate per 1000 spindle hours be in excess of 58, i.e. the difference have a positive sign, the thread guide will be lowered by the aforementioned increment. Conversely, should the next thread break rate be less than 58 over 1000 spindle hours, i.e. the difference have a negative sign, the thread guide will be raised by another increment.

In short, as long as the second thread break rate of the successively measured pairs is less than the first, the position of the thread guide is not yet optimal, although adjustment of the thread guide is in the correct direction. The process is repeated until there is no further improvement in the thread break rate, i.e. the thread break rate is at its minimum. When a subsequently measured thread break rate is poorer than the previous thread break rate, the previous adjustment increment is in the wrong direction and the direction of adjustment is reversed.

Figure 2:
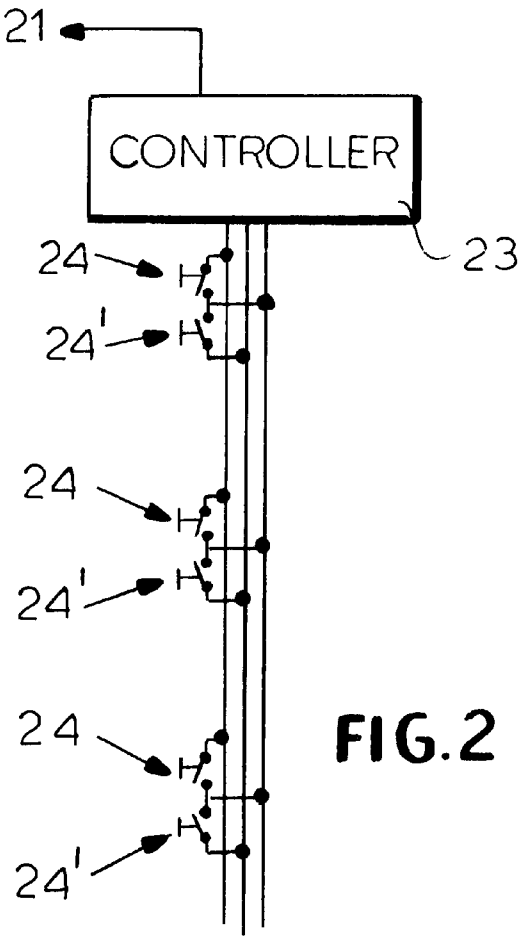

Of course the first positioning of the thread guide is "blind" positioning, i.e. is effected without knowledge whether a minimum has been achieved or not. To avoid this and ensure that the adjustment will be in the "correct" direction, separate counter switches 24, 24' can be provided for the two different types of thread breaks (i.e. a thread break in the spinning zone or a thread break in the balloon/winding zone) as has been shown, for example, in FIG. 2.

Figure 3:
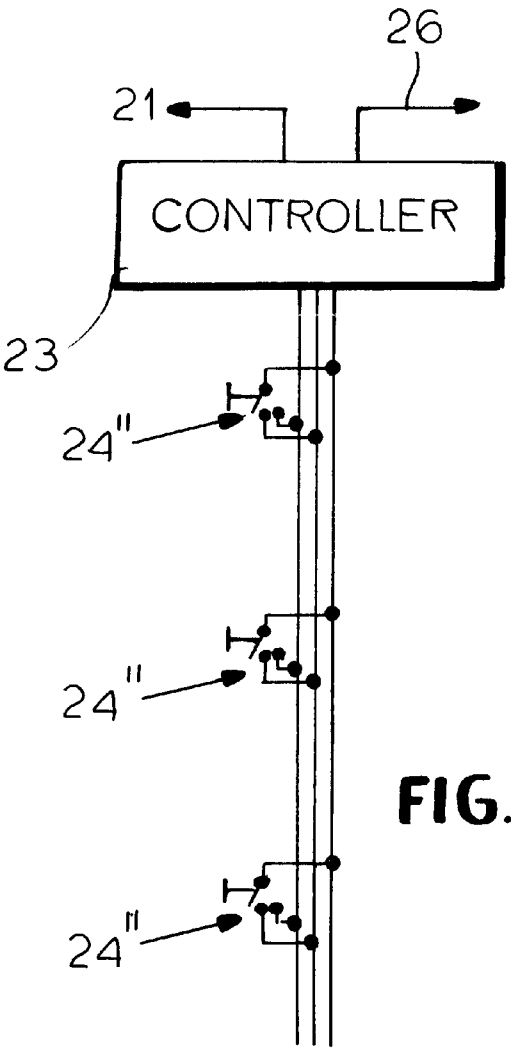
FIGS. 2 and 3 are details of other embodiments of the control for the system of FIG. 1.

Alternatively, as has been shown in FIG. 3, counter actuating switches or push buttons 24" can be provided by means of which a count can be given to signal a thread break in the spinning zone or in the balloon/winding zone, depending upon the depression of the switch actuator to a greater or lesser extent. This approach ensures earlier detection of the direction of adjustment of the thread guide 10 toward the minimum.

When the detected minimum of the thread break rate is less than a certain tolerable thread break rate, the spindle speed of the ring-spinning machine can be increased and the production thereby improved until the tolerable thread break rate is reached. At this operating point of the ring-spinning machine, there is an optimum thread break rate at an optimum production speed. Conversely, when the minimum thread break rate lies above the tolerable thread break rate, the spindle speed must be reduced until a tolerable thread break rate is reached.

To automate this control arrangement, the control unit 23 can store a set point thread break rate in a memory 23". The stored set point thread break rate can be compared with the minimum achieved as described above and, upon deviation of this minimum from the stored value, an output can be provided at 30 to the spindle speed control to increase the spindle speed should the determined minimum be less than the stored thread breakage rate or reduce the spindle speed upon the comparison showing a thread break minimum in excess of the stored set point value.

We claim:

1. A method of operating a ring spinning machine having a drawing frame through which a yarn passes from an output roller pair of the drawing frame onto a headpiece of a spindle through a thread guide upstream of said headpiece for winding of the yarn on a bobbin sleeve on said spindle after the yarn has passed through the respective thread guide onto the respective headpiece at each of a multiplicity of stations of the ring spinning machine, said method comprising the steps of:

(a) detecting during spinning operation of said ring-spinning machine a first thread-breakage rate of said multiplicity of stations with said thread guide at a first spacing from said headpiece over a first time interval;

(b) detecting a second thread-breakage rate of said multiplicity of stations over a second time interval subsequent to said first time interval and while the spinning operation of the ring-spinning machine is maintained; and (c) comparing said second thread-breakage rate with said first thread-breakage rate and determining a difference between said rates with a sign of the difference reflecting whether the first rate is greater than the second rate or vice versa, and adjusting said spacing in a direction determined by (a) said sign of a difference between said thread-breakage rates and so as to improve a spinning process of the ring spinning machine.

2. The method defined in claim 1 wherein said second thread breakage rate is compared with said first thread breakage rate and said spacing is adjusted so as to reduce the third breakage rate.

3. The method defined in claim 1 wherein, in the detection of a thread-breakage rate at each station, thread breakage rates of a spinning zone and a balloon/winding zone of the respective station are separately detected and the change in said spacing is effected in response to a difference between the detected thread breakage rates in said spinning zone and balloon/wind zone and so as to equalize the thread breakage rates.

4. The method defined in claim 3 wherein said thread breakage rates are detected by inputting a signal to counters from said stations depending upon whether a thread breakage occurs in said spinning zone and whether said thread breakage occurs in said balloon/winding zone.

5. The method defined in claim 1 wherein each said detection of thread breakage rates, each calculation of one of the thread breakage rate or each comparison of the thread breakage rates or each change in said spacing is effected automatically.

6. The method defined in claim 1 wherein each comparison of said thread breakage rates and each adjustment of said spacing are effected automatically.

7. The method defined in claim 1 wherein the process of steps (a) through (c) is repeated until a minimum thread breakage rate is determined, said minimum is compared with a maximum permissible thread breakage rate and the deviation of the minimum from the maximum permissible is varied until the minimum reaches the maximum permissible thread breakage rate.

8. A ring-spinning machine comprising at least one row of spindles formed with spindle headpieces;

a drafting frame having a pair of output rollers feeding yarn across a spinning zone to said headpieces, whereby said yarn from said headpieces forms a balloon and is wound on a bobbin on the respective spindle through a traveler on a ring in a balloon/winding zone;

a thread guide above each spindle and guiding said yarn between the respective headpiece and said rollers;

a common support for said thread guide;

means for raising and lowering said support; and control means responsive to thread breakage rates or thread breakage counts for operating said means for raising and lowering said supports so as to improve a spinning process of the ring-spinning machine.

9. The ring-spinning machine defined in claim 8 wherein said control means includes means for automatically detecting thread breakages.

10. The ring-spinning machine defined in claim 8 wherein said control means is connected with hand-actuated switches operable by service personnel to signal thread breakages.

11. The ring-spinning machine defined in claim 8 wherein said control means includes switch means for signalling thread breakage separately in said zones.

12. The ring-spinning machine defined in claim 8, further comprising means for storing a set point value of a thread breakage rate, means for comparing an actual value of said thread breakage rate with said set point value and means for varying a speed of spindles of the ring-spinning machine as a function of the resulting comparison.

* * * * *